United States Patent [19]

Adenheuer et al.

[11] 4,301,648

[45] Nov. 24, 1981

[54] FRICTION FALSE TWIST APPARATUS HAVING DOOR MOUNTED YARN THREAD-UP

[75] Inventors: Frank Adenheuer, Wuppertal; Gerd Munnekehoff, Remscheid, both of Fed. Rep. of Germany

[73] Assignee: Barmag Barmer Maschinenfabrik AG, Remscheid, Fed. Rep. of Germany

[21] Appl. No.: 173,920

[22] Filed: Jul. 31, 1980

[30] Foreign Application Priority Data

Aug. 8, 1979 [DE] Fed. Rep. of Germany ..... 2932075

[51] Int. Cl.[3] ..... D02G 1/08; D01H 15/00

[52] U.S. Cl. ..... 57/280; 57/339; 57/348

[58] Field of Search ..... 57/337–340, 57/279, 280, 348

[56] References Cited

U.S. PATENT DOCUMENTS

| | | | |
|---|---|---|---|
| 3,287,890 | 11/1966 | McIntosh et al. | 57/339 |
| 3,762,149 | 10/1973 | Raschle | 57/339 |
| 3,911,661 | 10/1975 | Naylor | 57/280 X |
| 3,942,313 | 3/1976 | Gassner et al. | 57/339 |
| 3,955,350 | 5/1976 | Schuster | 57/339 |
| 4,149,366 | 4/1979 | Bass et al. | 57/280 |
| 4,226,080 | 10/1980 | Bieber et al. | 57/280 X |
| 4,235,071 | 11/1980 | Dillon | 57/280 |

*Primary Examiner*—John Petrakes

*Attorney, Agent, or Firm*—Bell, Seltzer, Park & Gibson

[57] ABSTRACT

A yarn friction false twist apparatus is provided which comprises three sets of friction discs mounted on rotatable spindles in a triangular arrangement, and which includes a plurality of yarn deflecting arms for moving the yarn from an inoperative laterally spaced position where thread-up may be effected, to an operative path of travel disposed centrally between the sets of discs and wherein twist is imparted to the yarn by contact with the rotating discs. The yarn deflecting arms are mounted on a pivotally mounted door which also serves to protectively cover the sets of discs during operation. Each of the yarn deflecting arms has an open yarn guide at the forward free end thereof, with the length of the arm being such that the guide is free of contact with the yarn during the twisting operation. Also, there is provided a fixed yarn catch mounted below the discs in axial alignment with the operative path of travel for operatively engaging and retaining the yarn upon the yarn being moved toward the operative path of travel and whereby the yarn may be guided from the operative path of travel to a position exteriorly of the area encompassed by the endless drive belt for the spindles.

7 Claims, 4 Drawing Figures

FRICTION FALSE TWIST APPARATUS HAVING DOOR MOUNTED YARN THREAD-UP

The present invention relates to an apparatus for friction false twisting a moving yarn, and which has an improved thread up capability.

In the processing of synthetic thermoplastic yarns, it is common to impart "false twist" to the yarn to improve its elasticity and bulk. Typically, such "false twist" is applied in a continuous process, wherein a moving yarn is subjected to simultaneous twisting, heat setting, cooling, and untwisting, and which results in the twist being permanently set into the yarn.

A known friction false twist apparatus for false twisting and crimping synthetic filament yarns consists of three spindles which are rotatably mounted in a bedplate at the corner points of an equilateral triangle, and which are driven in the same direction. Friction discs are stacked on the spindles so as to overlap in the center of the triangle, and thereby define a zigzag-like shape of the operational yarn path of travel. In this known friction false twist apparatus, one spindle may be separated from the other two to make threading possible, note for example U.S. Pat. No. 3,813,868.

Friction false twist apparatus are also known wherein the three spindles are rotatably mounted about fixed axes on the bedplate, and are driven by a common endless drive belt, note for example commonly owned Dillon U.S. application ser. No. 17,447, filed Mar. 5, 1979, now U.S. Pat. No. 4,235,071. In such apparatus, the bedplate is provided with a threading slot which extends laterally between two spindles and so as to communicate with the central area of operation, and so as to permit the yarn to be threaded through the apparatus without passing through the area encompassed by the endless drive belt. To effect thread-up the yarn is first inserted in the cusp between two adjacent sets of friction discs and then pushed along the slot to the center of the equilateral triangle by suitable yarn guides. These thread-up yarn guides, which can be pivoted about an axis parallel to the spindles of the friction discs, and which move between the cusp of the discs and the operational yarn path of travel in planes which are parallel to the friction discs, perform the additional function of a yarn guide during the operation of the apparatus. This, however, is disadvantageous, since the yarn guides cannot be removed from the operational path of travel. Thus, for example, they cannot be cleaned during operation. Another disadvantage results from the fact that each yarn guide is a point of friction on the running yarn, which adversely affects the yarn tension and the twist distribution in the yarn.

The false twist apparatus as described above also presents a safety problem when operating at high speeds, since it is possible that the friction discs may have concealed manufacturing defects which can result in the bursting of the discs from the high centrifugal forces.

It is accordingly an object of the present invention to alleviate the risk of injury which may result from the bursting of the rotating friction discs.

It is a more particular object of the present invention to provide a door which is mounted to both protectively cover the sets of friction discs, and also mount the thread-up yarn guides.

It is a further object of the present invention to provide a friction false twist apparatus having spindles mounted for rotation about fixed axes, and wherein the thread-up may be readily accomplished without the need to thread the yarn through the discs of the spindles, or through the area encompassed by the endless drive belt, and wherein the thread up mechanism is free of contact with the yarn during the normal twisting operation.

These and other objects and advantages of the present invention are achieved in the embodiment illustrated herein by the provision of a false twisting apparatus which comprises a twisting assembly which includes at least three spindles mounted for rotation about fixed parallel axes, and a plurality of circular discs mounted on each spindle and defining an operative yarn path of travel between the sets of discs. A movable yarn deflecting means is provided for selectively moving a yarn from an inoperative thread-up position disposed laterally of the operative path of travel, toward the operative path of travel, and which comprises a door having a size sufficient to cover one side of the twisting assembly, at least one arm extending laterally from the inside of the door, and means mounting the door for pivotal movement between an open position disposed laterally from the spindles and a closed position immediately adjacent and covering one side of the twisting assembly. The free end of the arm is disposed in substantial axial alignment with the inoperative position when the door is opened, and the free end moves toward the operative path of travel upon movement of the door toward its closed position. Thus the thread-up of the yarn through the apparatus may be readily accomplished while the spindles are operatively rotating, and the door acts to cover the rotating sets of discs.

In the preferred embodiment, the apparatus further comprises yarn guide means for guiding the moving yarn between the operative path of travel and a position exteriorly of the area encompassed by the endless drive belt of the spindles. This yarn guide means includes a yarn catch fixedly mounted in axial alignment with the operative path of travel and intermediate all of the discs and the drive belt, so as to operatively engage and retain the running yarn upon the yarn being moved from its inoperative thread-up position toward the operative path of travel. In addition, each of the arms of the movable yarn deflecting means includes an open yarn guide at the forward free end thereof, and the length of the arms is such that the guide is free of contact with the yarn in its operative path of travel.

Some of the objects and advantages of the invention having been stated, others will appear as the description proceeds, when taken in connection with the accompanying drawings, in which FIG. 1 is a somewhat schematic perspective view of the friction false twist apparatus embodying the features of the present invention;

Figures 1, 2:
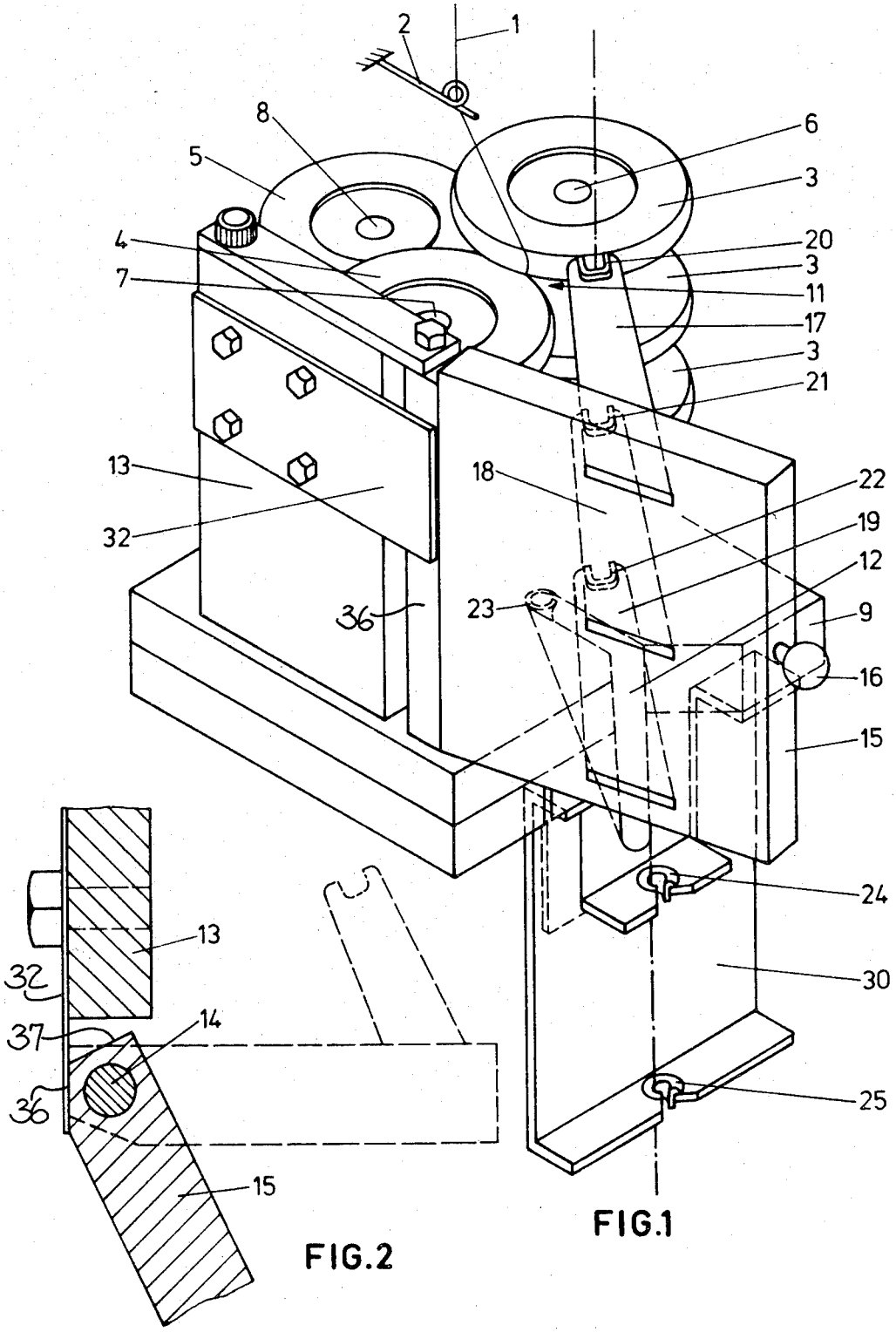
FIG. 2 is a fragmentary sectional plan view of the mounting arrangement for the door of the apparatus shown in FIG. 1, and illustrating the open position in solid lines and the closed position in dashed lines.

As shown in FIG. 1, the friction false twist apparatus includes a bedplate 9. The yarn twisting assembly comprises three parallel spindles 6, 7, 8 which are mounted to the bedplate in ball bearings (not shown) and at the corner points of an equilateral triangle. Each shaft holds a plurality of circular friction discs to thereby define three disc sets or stacks 3, 4, 5. The friction discs overlap in the central area between the spindles, and thereby define a zigzag operative path of travel between the disc sets and wherein the running yarn is false twisted by contact with the rotating discs.

The bedplate includes opposite sides 33, 34 (note FIG. 3), and the spindles extend through the bedplate and mount pulleys 28 on the lower side thereof. An endless belt 27 is disposed about the pulleys 28 to drive the spindles in a common direction. Thus the belt runs essentially in a triangle, and is disposed adjacent the bottom side 34 of the bedplate.

The apparatus further comprises movable yarn deflecting means for selectively moving the yarn from an inoperative thread-up position (shown in dashed lines in FIG. 1) laterally toward the operative path of travel which is located centrally between the sets of discs. This deflecting means comprises a mounting post 14 positioned on the bedplate adjacent and parallel to the spindles, a door 15 pivotally mounted on the post 14, and three deflecting arms 17, 18, 19 of like configuration mounted in an axial spaced apart and aligned arrangement on the inside of the door. An open yarn guide 20, 21, 22 is positioned at the free end of each arm 17, 18, 19 respectively.

The door 15 has a size sufficient to cover the front side of the twisting assembly, and includes a handle 16 to facilitate pivotal movement between an open position disposed laterally from the spindles as seen in FIG. 1, and a closed position wherein the door is aligned with the front edge of the bedplate and covers the front side of the twisting assembly. In the open position, the yarn guides 20, 21, 22 are disposed in general axial alignment with the inoperative position of the yarn, and the guides move horizontally toward the operative path of travel when the door is closed.

In the illustrated embodiment, the middle arm 18 is disposed to move in a plane intermediate the uppermost and lowermost of the discs, while the arm 19 moves in a plane below all of the discs, and the arm 17 moves in a plane above all of the discs. By design, the arms 17, 18, 19 have a length such that the guides 20, 21, 22 are positioned adjacent but short of the operative path of travel when the door is closed, such that the guides do not contact the running yarn during the twisting operation. Leaf spring 32 is mounted on side wall 13 of the friction false twist apparatus and, as best seen in FIG. 2, presses against one of the flat surfaces 36, 37 at the end of door in the area of post 14, so that the door is in a stable position both when it is opened and closed.

To avoid the need for the yarn to be threaded through the belt 27 before start-up, there is provided a slot 12 in the bedplate which communicates with the front edge thereof and extends in a direction which corresponds to the direction of yarn movement when the yarn is moved toward its operative path of travel as described above. The slot has an inner end which is axially aligned with the operative path of travel, and a slotted yarn catch 23 is mounted at the inner end of the slot so as to be aligned with the operative path of travel. A guide plate 35 is mounted below the bedplate, and includes an inclined channel 26 which is aligned with the slot 12. As will be apparent, the yarn is thereby able to freely pass through the bedplate upon movement of the running yarn from the inoperative thread-up position adjacent the spindles to the operative path of travel between the spindles.

Figure 3:
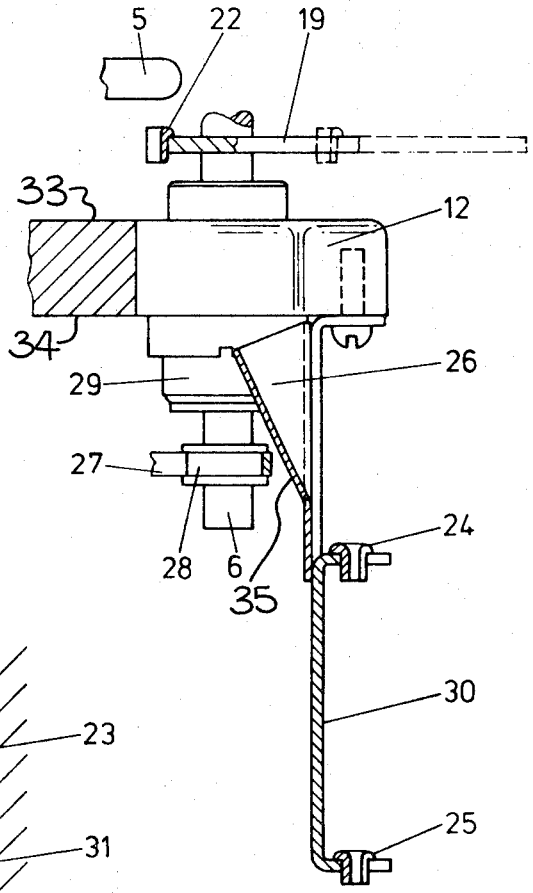
FIG. 3 is a fragmentary sectional elevation view of the apparatus shown in FIG. 1.

During operation, yarn 1 first travels through the fixed upper yarn guide 2 arranged above the friction false twist apparatus and then through the center of the friction disc sets 3, 4, 5, until it reaches the last disc of friction disc set 5 (see FIG. 3). From there, the yarn moves through the fixed yarn catch 23 mounted on bedplate 9, along the bypass channel 26 which is inclined to the front, and finally through the fixed yarn guides in the form of slotted eyelets 24 and 25 located on the protective plate 30 below the bedplate. Thus, the yarn bypasses the triangular area encompassed by the belt 27.

Figure 4:
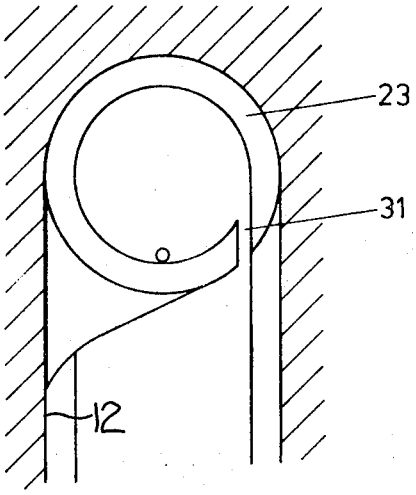
FIG. 4 is a fragmentary plan view of the yarn catch of the present invention.

To thread the yarn, the door is opened and the yarn is first placed in the fixed yarn guide 2 and then tensioned along the cusp which is formed between friction disc sets 3 and 4 on the front side of the friction false twist apparatus. The door is then closed, causing the door and arms 17, 18, 19 to be pivoted about the post 14. In doing so, the yarn guides 20, 21, 22, which are open in front, push the yarn through the outer cusp between friction disc sets 3 and 4 and into the center between spindles 6, 7, 8. Since yarn catch 23 provided in the bedplate is constructed as a self-catching yarn eyelet having a threading slot 31 which is laterally offset from its center, note FIG. 4, the yarn is caught and retained when it is pushed to the operative path of travel, and simultaneously also threaded into the slotted yarn eyelets 24, 25.

The door may be made of transparent material to permit inspection of the false twist process. This, however, is not required with the illustrated embodiment, since yarn guides 20, 21, 22 on arms 17, 18, 19 are open in front, i.e. on their side directed toward the operative path of travel and, therefore, have no further function after the yarn has been brought to its operative position. Therefore, the door may be opened at any time without adversely affecting the operational path of travel.

In the drawings and specification there has been set forth a preferred embodiment of the invention, and although specific terms are employed, they are used in a generic and descriptive sense only and not for purposes of limitation.

What is claimed is:

1. An apparatus for friction false twisting a moving yarn, and characterized by the ability to readily permit thread-up while the apparatus is in operation, and while alleviating the risk of injury from the rotating spindles, and comprising a mounting bedplate, a yarn twisting assembly comprising at least three spindles mounted to said bedplate for rotation about fixed, parallel axes which are positioned at the corner points of an equilateral polygon having a number of sides corresponding to the number of spindles, and a plurality of circular discs mounted on each spindle for rotation therewith, and with the discs of the spindles overlapping at a point centrally between said spindles and defining an operative path of travel extending axially therebetween, means for concurrently rotating each spindle in a common direction and such that twist is imparted to a yarn moving along said operative path of travel by contact with the rotating discs, movable yarn deflecting means for selectively moving a yarn from an inoperative thread-up position disposed laterally of said operative path of travel, toward said operative path of travel, and comprising a door, at least one arm carried by and extending from one side of said door, and means mounting said door to said bedplate for pivotal movement about an axis disposed parallel to the spindle axes and between an open position disposed laterally from said spindles and a closed position immediately adjacent and extending along one side of said twisting assembly, and wherein the free end of said arm is disposed in substantial axial alignment with said inoperative position when said door is open, and such free end moves toward said operative path of travel upon movement of said door to its closed position, whereby the thread-up of the yarn through the apparatus may be readily accomplished while the spindles are operatively rotating, and the door acts to protectively cover the rotating discs of the twisting assembly.

2. The apparatus as defined in claim 1 wherein a plurality of arms of like configuration are carried by and extend from said one side of said door, said arms being mounted in spaced apart, axially aligned relationship and with each arm including an open yarn guide at the free end thereof.

3. The apparatus as defined in claim 2 wherein said arms have a length such that said open yarn guides are positioned adjacent but short of said operative path of travel when the door is in its closed position.

4. The apparatus as defined in any one of claims 1–3 wherein said door is transparent.

5. The apparatus as defined in any one of claims 1–3 wherein said deflecting means further comprises detent means for selectively and releasably retaining said door in each of its open and closed positions.

6. An apparatus for friction false twisting a moving yarn, and characterized by the ability to readily permit thread-up while the apparatus is in operation, and while alleviating risk of injury from the rotating spindles, and comprising a mounting bedplate, a yarn twisting assembly comprising at least three spindles mounted to said bedplate for rotation about fixed, parallel axes which are positioned at the corner points of an equilateral polygon having a number of sides corresponding to the number of spindles, and a plurality of circular discs mounted on each spindle for rotation therewith, and with the discs of the spindles overlapping at a point centrally between said spindles and defining an operative path of travel extending axially therebetween, means for concurrently rotating each spindle in a common direction and such that twist is imparted to a yarn moving along said operative path of travel by contact with the rotating discs, and comprising a pulley coaxially fixed to each spindle, and a common endless drive belt operatively contacting each pulley, movable yarn deflecting means for selectively moving a yarn from an inoperative thread-up position disposed laterally of said operative path of travel, toward said operative path of travel, and comprising a door having a size to cover one side of said twisting assembly, at least one arm connected to and extending from one side of said door, and means mounting said door to said bedplate for pivotal movement about an axis disposed parallel to the spindle axes and between an open position disposed laterally from said spindles and a closed position immediately adjacent and covering one side of said twisting assembly, and wherein the free end of said arm is disposed in substantial axial alignment with said inoperative position when said door is open, and such free end moves toward said operative path of travel upon movement of said door to its closed position, yarn guide means for guiding the moving yarn between said operative path of travel and a position exteriorly of the area encompassed by said endless drive belt, said yarn guide means including yarn catch means fixedly mounted in axial alignment with the operative path of travel and intermediate all of said discs and said drive belt, for operatively engaging and retaining a running yarn upon the yarn being moved from said inoperative thread up position toward said operative path of travel, whereby the thread-up of the yarn through the apparatus may be readily accomplished while the spindles are operatively rotating, and without the need to manually thread the yarn through the discs of the spindles, or through the area encompassed by the endless drive belt, and wherein the door acts to cover the rotating spindles.

7. An apparatus for friction false twisting a moving yarn, and characterized by the ability to readily permit thread-up while the apparatus is in operation, and while alleviating the risk of injury from the rotating spindles, and comprising a mounting bedplate, a yarn twisting assembly comprising at least three spindles mounted to said bedplate for rotation about fixed, parallel axes which are positioned at the corner points of an equilateral polygon having a number of sides corresponding to the number of spindles, and a plurality of circular discs mounted on each spindle for rotation therewith, and with the discs of the spindles overlapping at a point centrally between said spindles and defining an operative path of travel extending axially therebetween, means for concurrently rotating each spindle in a common direction and such that twist is imparted to a yarn moving along said operative path of travel by contact with the rotating discs, movable yarn deflecting means for selectively moving a yarn from an inoperative thread-up position disposed laterally of said operative path of travel, toward said operative path of travel, and comprising a door, at least one arm carried by and extending from one side of said door, and means mounting said door to said bedplate for pivotal movement about an axis disposed parallel to the spindle axes and between an open position disposed laterally from said spindles and a closed position immediately adjacent and extending along one side of said twisting assembly, and wherein said arm is disposed outside of said inoperative position when said door is open, and wherein the free end of said arm moves through said inoperative position toward said operative path of travel upon movement of said door to its closed position, whereby the thread-up of the yarn through the apparatus may be readily accomplished while the spindles are operatively rotating, and the door acts to protectively cover the rotating discs of the twisting assembly.

* * * * *